US005267765A

United States Patent [19]

Diethelm et al.

[11] Patent Number: 5,267,765

[45] Date of Patent: Dec. 7, 1993

[54] LOAD CARRYING APPARATUS

[75] Inventors: Bruno Diethelm; Mathias Reichmuth, both of Küssnacht am Rigi, Switzerland

[73] Assignee: Schweizerische Eidgenossenschaft represented by Eidgenossische Flugzeugwerk, Switzerland

[21] Appl. No.: 656,149

[22] PCT Filed: Aug. 1, 1990

[86] PCT No.: PCT/CH90/00185

§ 371 Date: May 29, 1992

§ 102(e) Date: May 29, 1992

[87] PCT Pub. No.: WO91/01934

PCT Pub. Date: Feb. 21, 1991

[30] Foreign Application Priority Data

Aug. 4, 1989 [CH] Switzerland ..... 2895/89

[51] Int. Cl.[5] ..... B66C 1/36

[52] U.S. Cl. ..... 294/82.31; 294/82.34

[58] Field of Search ..... 294/82.17, 82.19, 82.21, 294/82.24, 82.31, 82.33, 82.34; 24/601.5, 601.6

[56] References Cited

U.S. PATENT DOCUMENTS

| | | | |
|---|---|---|---|
| 1,667,957 | 5/1928 | Stevenson . | |
| 2,116,880 | 5/1938 | Dee | 294/82.21 X |
| 2,131,445 | 9/1938 | Lawton | 294/82.33 |
| 2,421,152 | 5/1947 | Jones . | |
| 2,422,839 | 6/1947 | Maskey | 294/82.24 X |
| 2,667,376 | 1/1954 | Schlachter | 294/82.34 X |
| 2,732,246 | 1/1956 | Bernhart . | |
| 3,056,624 | 10/1962 | Nardone | 294/82.31 X |
| 3,224,803 | 12/1965 | Elsner et al. . | |
| 4,530,535 | 7/1985 | Hargreaves | 294/82.33 |
| 4,539,732 | 9/1985 | Wolner . | |

FOREIGN PATENT DOCUMENTS

| | | |
|---|---|---|
| 63936 | 10/1955 | France . |
| 1182603 | 2/1970 | United Kingdom . |

*Primary Examiner*—David M. Mitchell
*Assistant Examiner*—Dean J. Kramer
*Attorney, Agent, or Firm*—Barnes & Thornburg

[57] ABSTRACT

In order to release the load the load hook of the apparatus is pivotable downwards. The stop pawl located in the mouth of the load hook is form-closed arrestable. The load hook is freely rotatable relative to the load rope around the axis of the load rope and is spring elastically supported in the load rope axis. The apparatus is specifically suitable for use with helicopters.

9 Claims, 3 Drawing Sheets

LOAD CARRYING APPARATUS

BACKGROUND OF THE INVENTION

1. Field of the Invention

The present invention relates to a load carrying apparatus, including a casing and a load hook pivotably mounted to the casing, a connection portion adapted for connection to a load rope, a stop pawl adapted to cooperate with the load hook at its mouth area, a device for a remote controlled pivoting of the load hook and thus opening of the mouth area of the load hook to release a load from the load hook.

2. Description of the Prior Art

Load carrying apparatuses of the kind set forth above are generally available specifically for use at helicopters. In the case of helicopters it is quite important that the load, if necessary, can be dropped from the load hook. The commonly known stop pawl located in the mouth area of the load hook is generally spring loaded and operates properly if the flight poses no problems. If, however, the helicopter suddenly stalls together with the load, it is possible that the load rope slackens and dislocates the stop pawl which is biassed by means of a spring in its locking position from the outside and thus leading to an opening of the mouth area of the load hook, such that a critical and dangerous situation can arise.

SUMMARY OF THE INVENTION

It is a general object of the present invention to provide a load carrying apparatus, by means of which mentioned dangerous situation cannot arise.

A further object is to provide a load carrying apparatus which comprises a locking bar supported to reciprocate inside of the casing of the apparatus between a locking position and a release position, which locking bar in its locking position is located in the path of the movement of the stop pawl into a load hook mouth area opening position, whereby an opening of the load hook mouth area is prevented.

A further object is to provide a load carrying apparatus having a stop pawl which is kept by means of a locking bar in a form closed manner in its locking position.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENT

Figure 1:
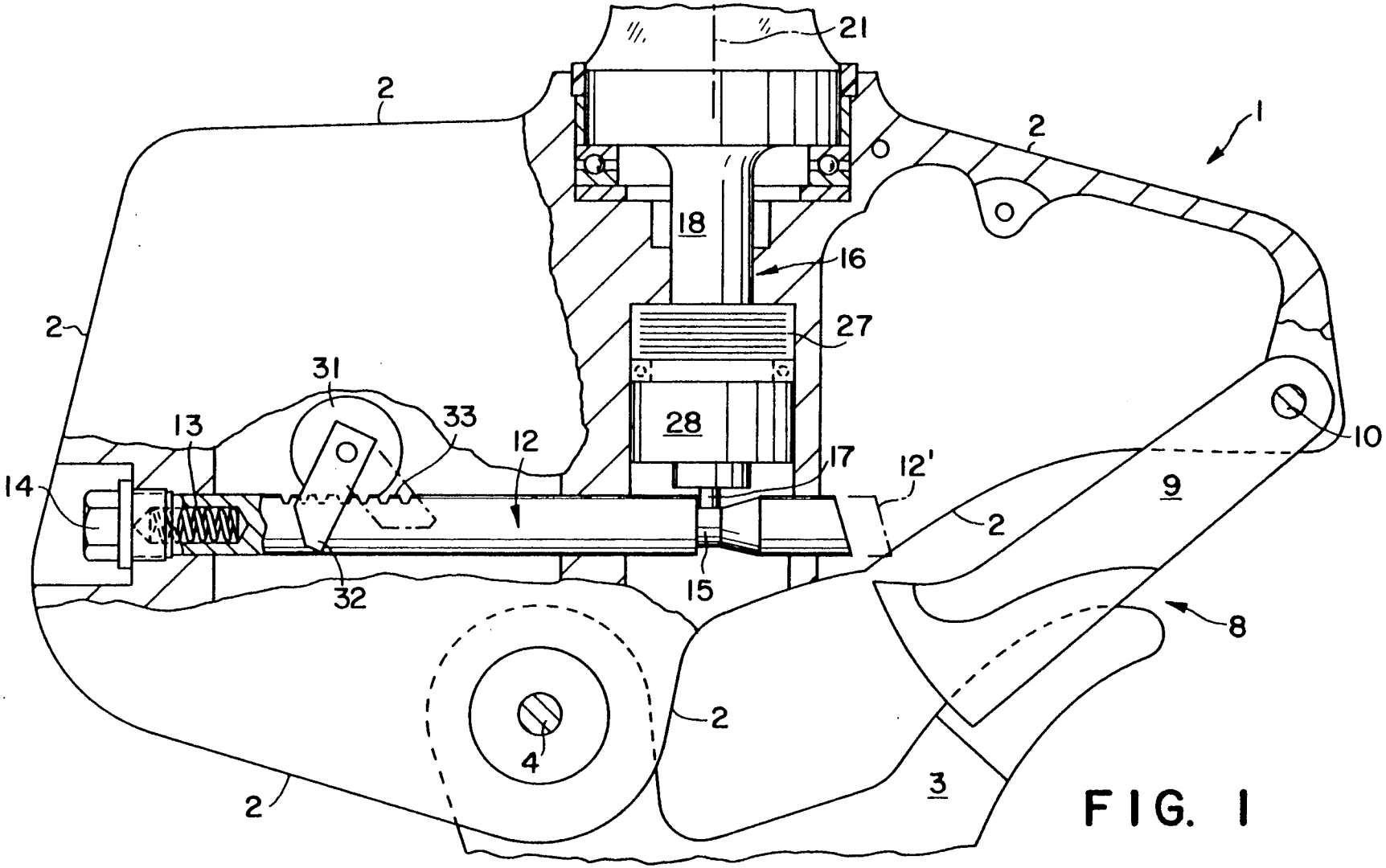
FIG. 1 is a side view of the lower part of the load carrying apparatus designed partly in section, without the load rope.
Figure 3:
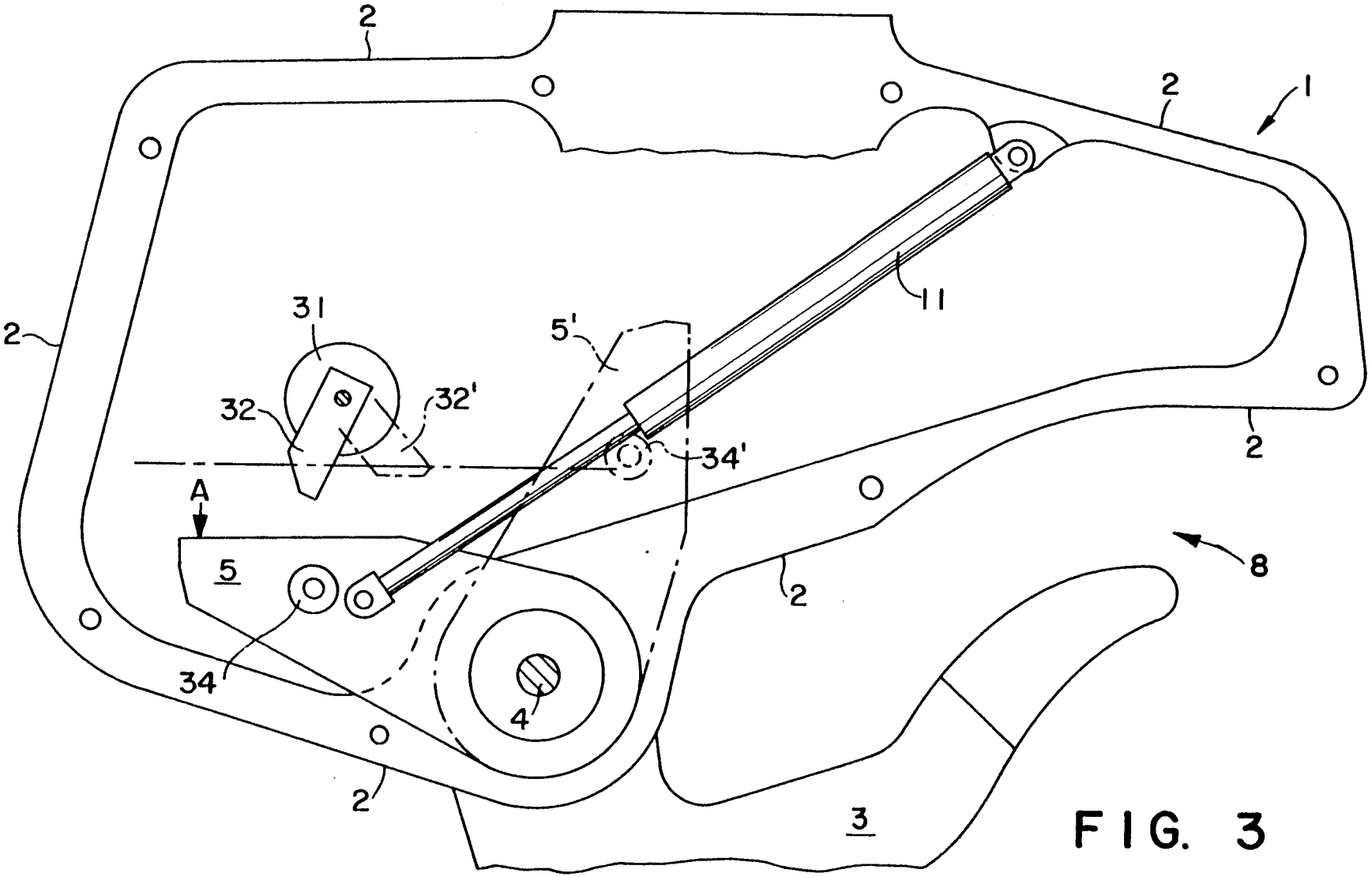
FIG. 3 is a view similar to the view of FIG. 1 of the vertically opened casing of the apparatus whereby the stop pawl is not illustrated.

The load carrying apparatus includes a casing 1 thereof having an outer contour 2. A load hook (swivel hook) 3 is pivotably mounted to the casing 1 such to pivot around the axis 4. The load hook 3 is mounted to an operating arm 5 to rotate therewith, which operating arm 5 is also pivotable around the axis 4. The apparatus has a connection portion identified by the reference numeral 6 for the load rope 7. As can be seen from FIG. 1, a stop pawl 9 is located at the mouth 8 of the hook, which stop pawl 9 is urged in a not specifically illustrated fashion by means of a spring member into a hook mouth 8 locking position in accordance with FIG. 1, whereby the stop pawl 9 is pivotable around the position 10. In FIGS. 1 and 3 the load hook 3 is in its operative position, in which it accordingly is adapted for carrying a load. The load hook 3 is pivotable into its nonoperational position, in which position thus the mouth 8 of the hook is opened and the load is released from the load hook 3 by means of a not illustrated device or system, respectively, for a remote controlling of the load hook 3. Such devices or systems, respectively, are generally known and, therefore, not particularly illustrated. Merely it can be noted, that electrical signals are transmitted via the remote control to magnets which move a locking rod system, which removes an arresting member, which in the arresting position acts in the direction of the arrow A operationally as stop onto the operating arm 5. If such stop A is moved away, the load hook 3 can pivot in a clockwise direction and the operating arm 5 will then move into the position 5' indicated by dash-dotted lines. This movement of the operating arm 5 proceeds against the biassing force of a compressed gas spring 11. The relaxation of the compressed gas spring causes the load hook to move again back into its illustrated operational position. This particular design of the load carrying apparatus is of a commonly known nature.

Figure 2:
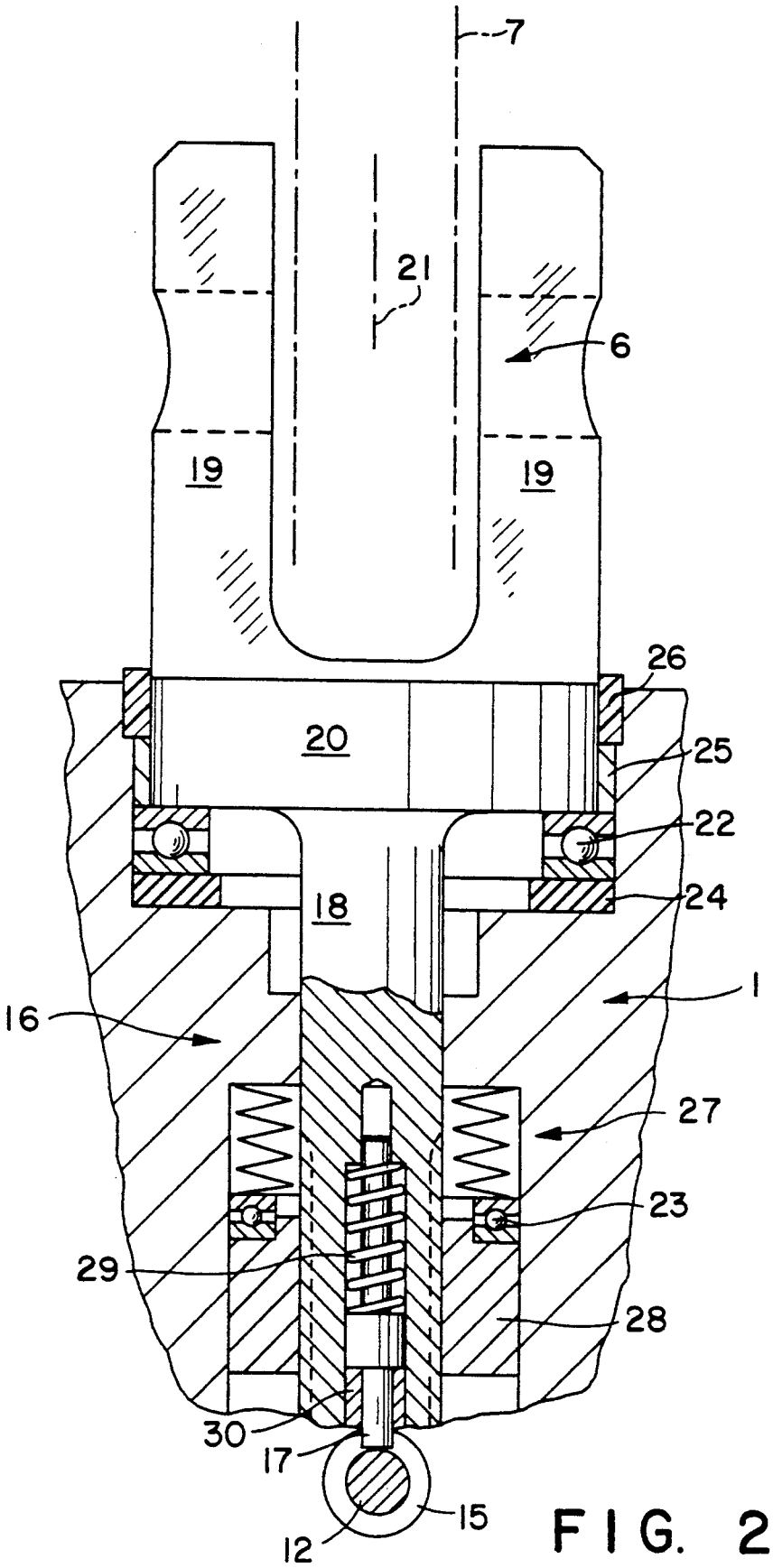
FIG. 2 illustrates on a larger scale a detail of the apparatus illustrated in FIG. 1 and rotated relative thereto by 90° and including an indication of the load rope.

As illustrated in FIG. 1, a reciprocably movable locking bar in form of a rod 12 is located in the casing 1 of the apparatus. This bar is displaceable in its axial direction and its nonoperating position is illustrated in FIG. 1 by full lines and its operating position 12, is illustrated by dash-dotted lines. This bar 12 is biassed in its axial direction by means of a spring 13 which strives to push the bar 12 according to the illustration of FIG. 1 towards the right side into its locking position 12' (operational position). This spring 13 rests, therefore, at the one end against this rod 12 and at the other end against a pin 14 with a thread at the casing 1. The rod has a annular groove 15, into which an arresting device 16 can engage via its spring loaded projection 17, such as illustrated in FIGS. 1 and 2. At its bottom end the arresting device 16 has a supporting stub 18 and at its top it has a forked end 19 for the connection portion 6 for the load rope 7. The arresting device 16 includes a cylinder shaped portion 20 located between the supporting stub 18 and the forked end 19, which cylinder shaped portion 20 is supported in the casing 1 of the apparatus to rotate around the axis 21. Hereto two antifriction bearings 22 and 23 are provided. An elastic ring 24 is located under the antifriction bearing 22, and further a distance ring 25 and a sealing ring 26, as well, are arranged thereat. The arresting device 16 with the connection portion 6 is supported relative to the casing 1 of the apparatus for a vertical movement against the force of a second spring 17 (pile of cup springs), i.e. in the direction of the axis 21, whereby then the cylinder shaped portion 20 lifts off upwards from the anti-friction bearing 22 in FIG. 2. The arresting device 16 is hereby supported via a nut 28 and the antifriction bearing 23 by the pile of cup springs 27. The projection 17 designed as pin is seated in the lower end of the supporting stub 18, which projection 17 is pressed by means of a spring 29 downwards against a bushing 30. Accordingly, the supporting stub 18 is located inside the second spring device 27 (pile of cup springs). Above the two antifriction bearings 22 and 23 the casing 1 of the apparatus is freely rotatable around the axis 21 relative to the load rope connection portion 6 and accordingly relative to the arresting device 16. By means of the pile of cup springs 27 the casing 1 of the apparatus is, furthermore, elastically supported in the direction of the longitudinal axis 21 against the load rope connection portion 6.

A gear wheel 31 is rotatably supported in the casing 1 of the apparatus and a drive member 32 having the shape of a pawl is mounted to the gear wheel 31. In one sense of rotation of the gear wheel this member 32 is fixedly mounted for rotation with the gear wheel and in the other sense of rotation of the gear wheel a free wheeling state between gear wheel 31 and drive member 32 prevails. The rod 12 includes a rack section 33 illustrated in FIG. 1, which meshes with the gear wheel 31. As shown in FIG. 3, the operating arm 5 supports a roller 34, which will engage the drive member 32 if latter is in the position 32', such as will be explained more in detail further below. If the operating arm 5 is located in its position 5', the roller 34 is located in the position 34' according to FIG. 3.

The operation of this apparatus is as follows:

When the apparatus is in its operational state, the load hook 3 is in a position as illustrated in FIGS. 1 and 3. Because the load rope 7 is in a no-loaded state because no load has been hooked onto the load hook 3, the entire apparatus is in a state as illustrated in FIG. 1, i.e. the rod 12 is in its nonoperational position (non-arresting position), because the projection 17 of the arresting device 16 is located in the annular groove 15, such that the spring 13 cannot urge the rod 12 into the position 12' of FIG. 1. Therefore, the stop pawl 9 illustrated in FIG. 1 can be pivoted upwards such that the mouth 8 of the load hook is given free, such that a load can be hooked onto the load hook 3. Thereafter, the stop pawl 9 moves again by spring action into the position illustrated in FIG. 1. If now the load hooked onto the load hook 3 is lifted off the ground by the helicopter and when this load has such a weight that the pile of cup springs 27 is compressed, the arresting device 16 is moved together with the projection 17 upwards according to FIG. 1 and disengages from the rod 12. Now, the spring 13 urges or pushes, respectively, the rod 12 into its locking or arresting, respectively, position 12'. The stop pawl 9 can now no longer pivot upwards based on FIG. 1, because it will hit the rod which now is in the position 12'. Accordingly, the mouth 8 of the hook is now closed. The helicopter transports now the load hooked onto the load hook 3 to the desired site, whereby the load can rotate freely together with the casing 1 of the apparatus due to the antifriction bearing 23 relative to the load rope connection portion 6. The cylinder shaped portion 20 of the arresting device 16 is thereby lifted off of the antifriction bearing 22. If now the helicopter suddenly stalls and the load rope 7 not subjected to a loading because of this stalling, the pile of cup springs 27 is relaxed and the arresting device 16 moves downwards relative to the casing 1 of the apparatus, whereby the projection 17 will impact onto the jacket surface of the rod 12 and now can yield inwards with a compressing of the spring 29. Because the rod 12 still is located in its position 12', it is not possible that the load hanging on the load hook 3 (and also not when the load rope is in a slackened condition 7) enters from the outside into the mouth 8 of the hook such that also the load cannot move out of the hook 3. The stalling of the helicopter and the free falling of the load together with the load supporting apparatus can be intercepted in a spring elastic manner by the pile of cup springs 27, whereby also impacts acting in the opposite direction are intercepted or taken up, respectively, by the elastic ring 24.

The rod 12 is still in its locking position 12'. It has been pressed by the spring 13 into this position, whereby the rack section 33 has rotated the gear wheel 31 to such an extent that the drive member 32 is in the position 32'. During this operation accordingly the drive member 32 was fixedly mounted for rotation to the gear wheel 31.

If now the helicopter is to release the load from the load hook 3 in a remote controlled operation, the load hook 3 is pivoted such as explained earlier in a remote controlled manner in a counterclockwise sense based on FIGS. 1 and 3, such that the mouth 8 of the hook is free and the load moves out of engagement with the load hook 3. During the downwards pivoting of the load hook 3 the operating arm 5 moves into the position 5'. The drive member 32 in its position 32' is located now in the path of movement of the roller 34. The drive member 32 pivots hereby in a counterclockwise direction without a moving of the gear wheel 31 because in this sense of rotation a free wheeling condition between gear wheel 31 and drive member 32 is present. The roller 34 moves into its position 34' and the rod 12 still remains in its locking or arresting, respectively, position 12'. After the load has been removed, the compressed gas spring 11 urges the operating arm 5 and accordingly the load hook 3 again into the position illustrated in FIG. 3 by full lines. The roller 34 impacts hereby onto the drive member located in the position 32' and pivots this member into the position illustrated by full lines. Hereby the drive member 32 is mounted for positive rotation together with the gear wheel 31 such that this leads to a rotating of the gear wheel 31 such that the rod 12 is moved against the force of the spring 13 into its nonoperational position. The locking bar designed as rod 12 is, thus, moved into its nonoperational position, whereby the load hook 3 is moved into its operational position. When the rod 12 is in its nonoperational position according to FIG. 1 and when the load has been removed, the projection 17 of the arresting device 16 snaps again into the annular groove 15 according to FIG. 1. The load hook 3 is now again in a state for receiving a new load because the stop pawl 9 in FIG. 1 has been pivoted to such a large extent upwards that the mouth 8 of the hook 3 is completely free or open, respectively.

While there is shown and described a present preferred embodiment of the invention, it is to be distinctly understood that the invention is not limited thereto, but may be otherwise variously embodied and practiced within the scope of the following claims.

We claim:

1. A load carrying apparatus, including a casing and a load hook pivotably mounted to the casing, a connection portion adapted for connection to a load rope, a stop pawl adapted to cooperate with the load hook at its mouth area, a device for a remote controlled pivoting of the load hook and thus opening of the mouth area of the load hook to release a load from the load hook, a locking bar supported to reciprocate inside of said casing between a locking position and a release position, which locking bar in its locking position is located in the path of the movement of said stop pawl into a load hook mouth area opening position, whereby an opening of said load hook mouth area is prevented, in which said locking bar comprises a spring member and a rod loaded by the spring member, whereby the spring member strives to push the rod into the locking position, and comprising a load dependent arresting device which is engagable with the rod for a non-displacement of said rod, whereby the arresting device is supported for a vertical movement at the casing of the apparatus by means of a second spring member.

2. The apparatus of claim 1, in which said second spring member is a pile of cup springs which rests at its one end against the casing of the apparatus and at its other end against the load rope connection portion, whereby a vertically elastic support of the casing of the apparatus relative to the load rope connection portion is formed.

3. The apparatus of claim 2, in which said supporting stub comprises a forked upper end for the load rope connection portion.

4. The apparatus of claim 1, in which said arresting device includes a supporting stub located within said second spring member and supporting the load rope connection portion, which supporting stub is rotatably supported in the casing of the apparatus for rotation around its longitudinal axis, whereby the casing of the apparatus is supported for free rotation relative to the load rope connection portion.

5. The apparatus of claim 4, in which said rod includes a rack section which meshes with a gear wheel mounted to said drive member to positively rotate therewith in the one sense of rotation and where a free wheeling is active between said gear wheel and said drive member in the opposite sense of rotation.

6. The apparatus of claim 4, in which a spring loaded pin is seated in said supporting stub of the arresting device which forms a spring loaded projection of said arresting device.

7. The apparatus of claim 2, in which said supporting stub of the arresting device is rotatably supported by antifriction bearings at the casing of the apparatus.

8. The apparatus of claim 1, in which the pivotable load hook includes a movable operating arm and a drive member for the reciprocal locking bar, which drive member is located in the path of movement of said operating arm, which drive member is adapted to move said locking bar during the pivoting movement of the load hook into its operational position.

9. The apparatus of claim 1, in which said locking bar comprises an annular groove adapted to receive said arresting device in a latched manner, whereby a moving of said locking bar into its locking position is prevented.

* * * * *